United States Patent [19]

Morris

[11] 4,429,615

[45] Feb. 7, 1984

[54] ARTICULATED FEEDER

[75] Inventor: Philip E. Morris, Irvine, Calif.

[73] Assignee: The United States of America as represented by the Secretary of the Army, Washington, D.C.

[21] Appl. No.: 369,313

[22] Filed: Apr. 16, 1982

[51] Int. Cl.[3] ..... F41D 10/14

[52] U.S. Cl. ..... 89/33 BB; 89/46

[58] Field of Search ..... 89/33 BB, 33 BC, 33 C, 89/33 CA, 46

[56] References Cited

U.S. PATENT DOCUMENTS

| | | | |
|---|---|---|---|
| 2,474,975 | 7/1949 | Goodhue | 89/33 BB |
| 2,993,415 | 7/1961 | Panicci et al. | 89/33 BB |
| 3,101,647 | 8/1963 | Greene | 89/46 |
| 4,244,270 | 1/1981 | Tassie | 89/33 C |
| 4,344,350 | 8/1982 | Golden | 89/33 E |

*Primary Examiner*—Stephen C. Bentley
*Assistant Examiner*—Donald G. Kelly
*Attorney, Agent, or Firm*—Robert P. Gibson; Anthony T. Lane; A. Victor Erkkila

[57] ABSTRACT

A feeder for transferring ammunition from a magazine to the loading assembly of an elevationally rotatable gun includes a first chute and a second chute. The first chute is pivotally mounted about the magazine. The second chute is articulated between the first chute and the loading assembly. The chutes are sized to provide an internal passage for the ammunition. An endless transfer chain can circulate along an interior path from the magazine through the chutes to drive the ammunition therethrough. This endless transfer chain returns from the interior path to the magazine along a return path. Linkage coupled to the endless transfer chain along its return path can draw it inwardly as the chutes unfold.

14 Claims, 8 Drawing Figures

FIG. 1
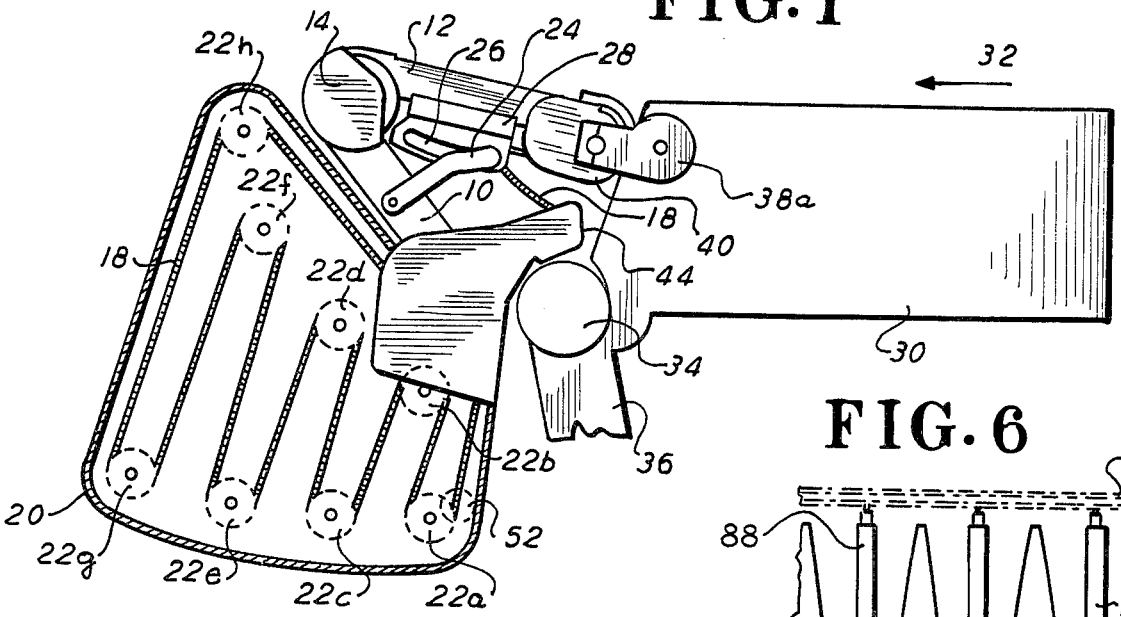
FIG. 6
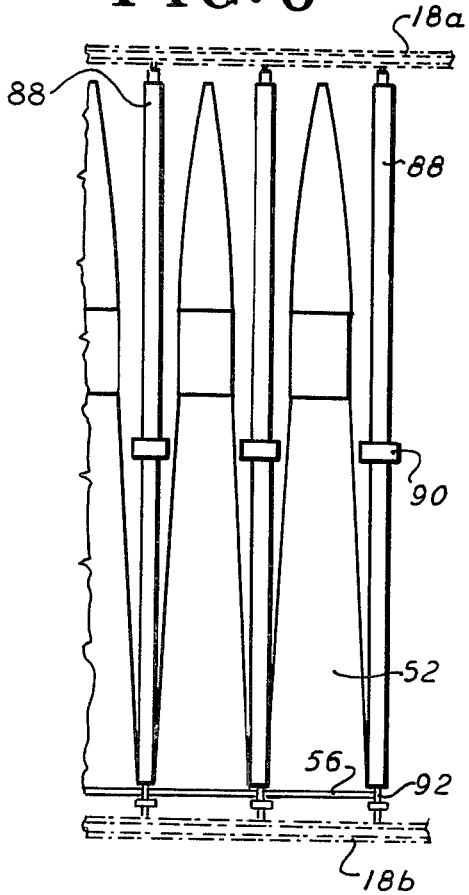
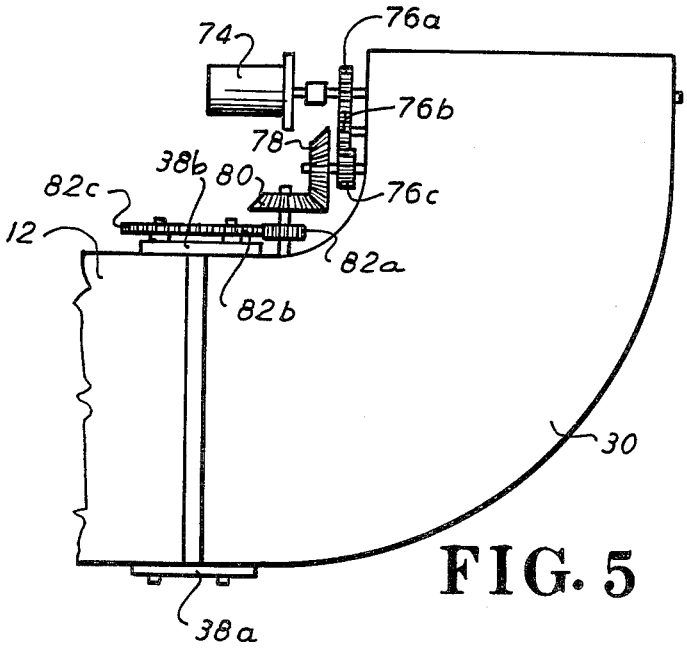
FIG. 5
FIG. 7
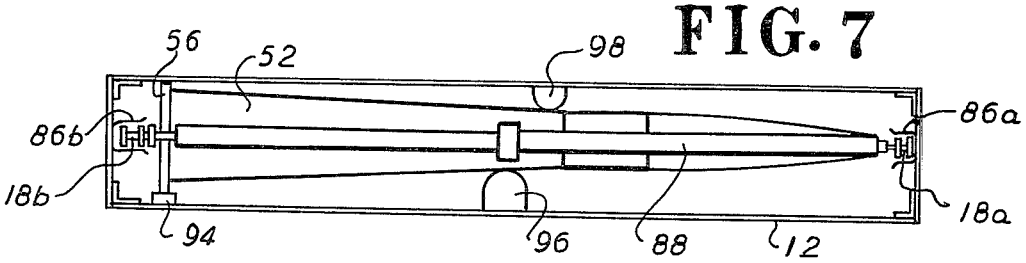

FIG. 2
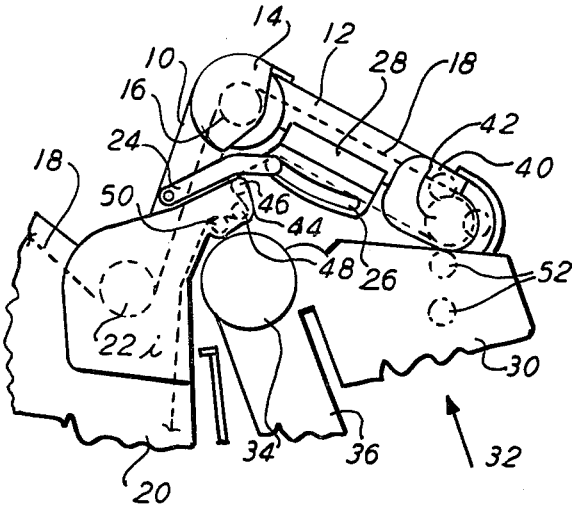
FIG. 3
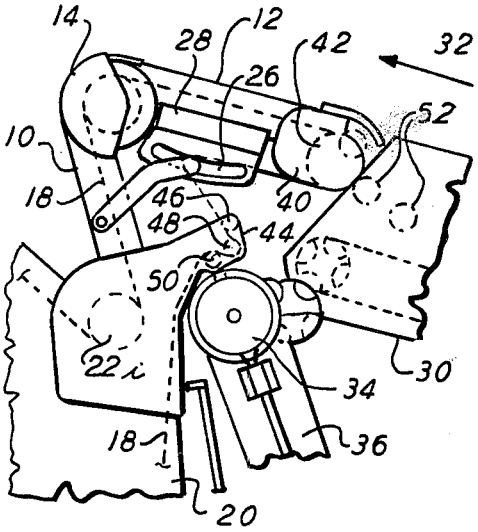
FIG. 4
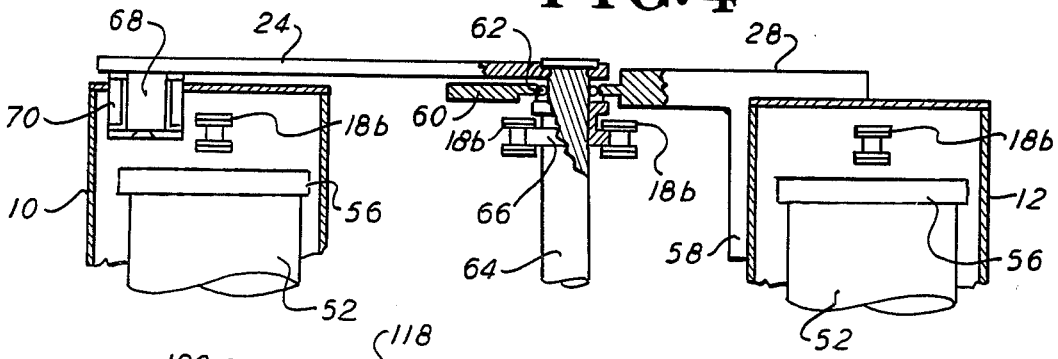
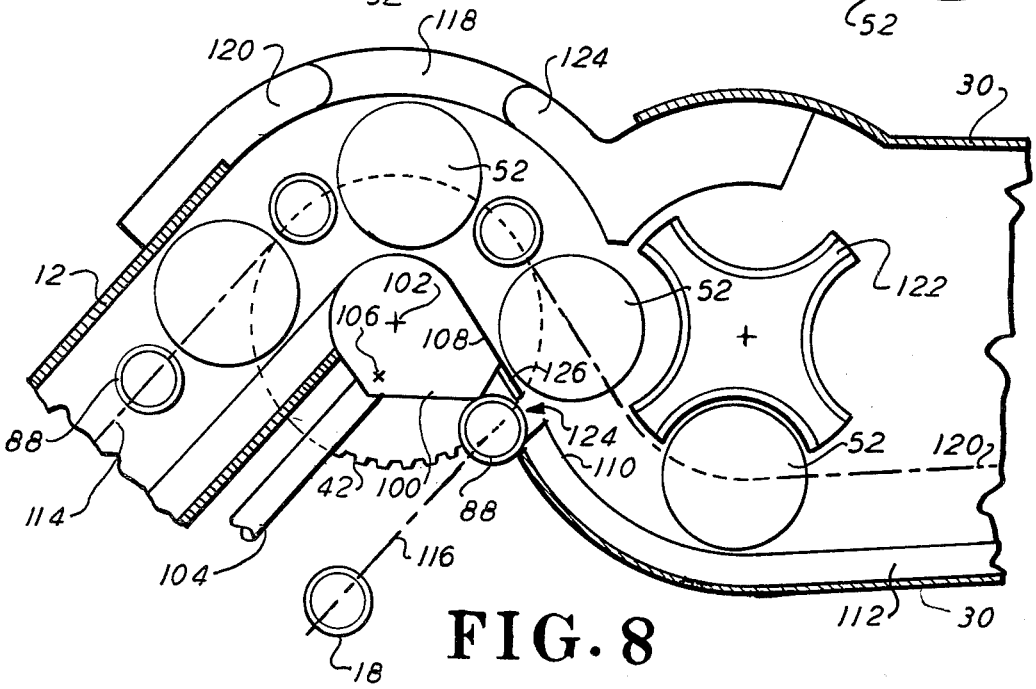
FIG. 8

ARTICULATED FEEDER

GOVERNMENT INTEREST

The invention described herein was made in the course of or under a contract or subcontract thereunder with the Government and may be manufactured, used and licensed by or for the Government for Governmental purposes without the payment to me of any royalties thereon.

BACKGROUND OF THE INVENTION

It is known to feed an elevationally adjustable gun from a magazine. Known magazines have been mounted on the gun to rotate with it. A disadvantage of such mounting is a significant increase in the rotating weight of the gun. This weight places additional load on the gun trunnions and increases the moment of inertia so that elevational rotation is more difficult.

A problem with mounting the magazine at a station off the gun is that the loading assembly for the gun can move with respect to the magazine as the gun rotates in elevation. This relative motion complicates the transfer of ammunition from the magazine to the gun.

A problem with designing an ammunition feeder having a chain and other parts moving to accommodate a moving gun is that rotation of the feeder and its chain changes the tension or slack in the chain. Taking up the slack in such an adjustable system is not readily performed by springs, since they cannot maintain sufficient tension while drawing the chain a considerable distance.

Accordingly, there is a need for a feeder system which can transfer ammunition from a stationary magazine to the loading assembly of an elevationally rotatable gun in a simple and effective manner.

SUMMARY OF THE INVENTION

In accordance with the illustrative embodiment demonstrating features and advantages of the present invention, there is provided a feeder for transferring ammunition from a magazine to a loading assembly of an elevationally rotatable gun. The feeder includes a first and second chute, an endless transfer means and a linkage means. The first chute is pivotally mounted about the magazine. The second chute is articulated between the first chute and the loading assembly. These chutes are sized to provide an internal passage for the ammunition. The endless transfer means can circulate along an interior path from the magazine through the chutes to drive the ammunition therethrough. This endless means returns from the interior path to the magazine along a return path. The linkage means is coupled to the endless means along its return path for drawing it inwardly as the chutes unfold.

By employing equipment of the foregoing type, ammunition can be readily transferred through two jointed chutes, preferably by means of a transfer chain circulating in part, through the chutes. In a preferred embodiment, there is linkage including a lever pivoted on one chute and slidably mounted in the slot of a bracket mounted on the other chute. The lever is arranged to rotate toward the joint of the first and second chutes as they unfold. Preferably, a sprocket wheel mounted on an axle fitted through the slot in the bracket on the chute operates as an idler. The relative motion of this idler draws the transfer chain inwardly. It will be appreciated that this inward drawing of the transfer chain is necessary since in the preferred embodiment, the joints at the ends of the chutes have coaxial sprocket wheels and the length of chain wrapped around the sprocket wheels decreases as the chutes unfold. This unwrapping tends to cause slack in the chain.

In a preferred embodiment, the transfer chains are a pair of chains transversely spanned by a plurality of parallel pusher bars between which individual rounds of ammunition fit. A reciprocating finger at the joint of the chutes to the gun is synchronized with the pusher bars to retract and allow passage of the bars as the transfer chains leave the chutes and start on the return path.

Also in a preferred embodiment, the chutes are fitted with tracks to guide the transfer chains. Also, the chutes may have ribs that surround the ammunition and prevent transverse motion. It is also preferred that the pusher bars have grooved ends which are sized to engage the rim of the ammunition and to prevent axial motion.

BRIEF DESCRIPTION OF THE DRAWINGS

The above brief description as well as other objects, features and advantages of the present invention, will be more fully appreciated by reference to the following detailed description of a presently preferred but nonetheless illustrative embodiment in accordance with the present invention when taken in conjunction with the accompanying drawings wherein:

FIG. 1 is a simplified side view (partially sectional) of a feeder connected between a magazine and gun in accordance with the principles of the present invention;

FIG. 2 is a detailed view of the apparatus of FIG. 1 showing the chutes in a fully unfolded position;

FIG. 3 is a detailed view of the apparatus of FIG. 1 showing the chutes partially unfolded;

FIG. 4 is a cross-sectional, end view through the chutes of FIG. 1;

FIG. 5 is a top view of the loading assembly of FIG. 1;

FIG. 6 is a plan view of the ammunition and transfer means within the chutes of FIG. 1;

FIG. 7 is a cross-sectional view of one of the chutes in FIG. 1; and

FIG. 8 is a detailed, sectional, elevational view of the joint between the second chute and loading assembly of FIG. 1.

DETAILED DESCRIPTION OF THE PREFERRED EMBODIMENT

Referring to FIGS. 1, 2 and 3, a feeder is illustrated comprising first chute 10 and second chute 12. In this embodiment, chutes 10 and 12 are sheet metal conduits having a rectangular cross-section. If desired, a series of large perforations may be made in one of the faces of chutes 10 and 12 to render their contents accessible in the event of jams. Chutes 10 and 12 are pinned together at joint 14. At the opposite ends of joint 14, sprocket wheels 16 (FIG. 2) are coaxially mounted to carry an endless tranfer means, shown herein as a pair of chains 18 (hereinafter the chains may be separately identified by reference numerals 18*a* and 18*b*).

Magazine 20 is shown in FIG. 1 (see also FIGS. 2 and 3) with its side broken away to reveal chains 18 being conducted along a serpentine path around sprocket wheel pairs 22*a*, 22*b*, 22*c*, 22*d*, 22*e*, 22*f*, 22*g*, 22*h* and 22*i* (hereinafter collectively referred to sprocket wheels 22). After traveling over sprockets 22*h* and 22*i*, chain 18 is conveyed (FIG. 2) along an interior path through chutes 10 and 12.

Chain 18 emerges from chute 12 along a return path to engage a linkage means shown herein as levers 24. Levers 24 comprise a pair of bent, parallel levers mounted coaxially on opposite sides of chute 10 to pivot thereon. The swinging ends of levers 24 are joined by an axle carrying a pair of sprockets (shown hereinafter) over which chains 18 travel. The swinging ends of levers 24 slide through curved slot 26 in a bracket 28 affixed to chute 12 (complementary bracket on other side of chute 12 is hidden in this view).

A loading assembly is shown herein as fan 30. Fan 30 is a curved conduit arranged to translate rounds 52 of ammunition and rotate their axes 90° so they can be directly loaded into the gun of the loading assembly 30. The direction in which the gun (not shown) points is illustrated by arrow 32. Trunnion 34 rotatably supports the gun and its loading assembly 30. Elevator 36 (FIG. 3) raises rounds from a lower and separate magazine (not shown) and feeds rounds past trunnion 34 into loading assembly 30. These rounds enter loading assembly 30 on a lower level. Only one level feeds the gun at a time.

The joint between loading assembly 30 and chute 12 is formed by hinge plate **38*a* (complementary plate on far side hidden from view) which rotatably connects fan 30 to the hand-off assembly 40. Assembly 40 is illustrated in further detail hereinafter. It will be noted that hand-off assembly 40 includes sprocket wheels 42 (FIGS. 2 and 3) over which transfer chains 18 travel before leaving chute 12 to travel over the return path. Chains 18 return to magazine 20 through arms 44 which carry idler wheel pairs 46, 48 and 50. Idler pair 50 is adjustable transversely to the path of chains 18** to establish their tension.

The ammunition illustrated herein comprises a series of rounds 52 which are conveyed by chains 18 along an interior path through magazine 20, chutes 10 and 12, thence into loading assembly 30. While only a few of the rounds 52 are illustrated herein, it is to be appreciated that they are closely spaced and fill the magazine and chutes before they are fired.

Referring to FIG. 4, the linkage means of FIG. 1 is shown in further detail as a cross-sectional view through chutes 10 and 12. Chain **18*b* is shown riding behind rim 56 of ammunition 52. Bracket 28 is shown as a plate having a perpendicular projection 58 forming a corner engaging the corner of chute 12. The outer end 60 of bracket 28 is narrowed and has within its slot 26 (FIG. 1) a set of cam rollers 62 (FIG. 4). Cam roller 62 engages an axle 64 which also supports on each end a pair of sprocket wheels, one illustrated herein as a sprocket 66. Chain 18*b* is shown riding over sprocket 66. Previously illustrated lever 24 is shown pivotally connected to axle 64 and pivotally connected through pivot 68 to bearing 70 mounted in chute 10**.

Referring to FIG. 5, loading assembly 30 is illustrated as a curved conduit linked to previously illustrated chute 12 by means of hinge plates **38*a* and 38*b*. A drive motor 74 is shown driving gears 76*a*, 76*b* and 76*c* to rotate bevel gears 78 and 80. Accordingly, bevel gear 80 rotates gears 82*a*, 82*b* and 82*c* to provide the motive force for the hand-off mechanism between chute 12 and loading assembly 30** which is described hereinafter in further detail.

Referring to FIGS. 6 and 7, a plan and transverse, cross-sectional view, respectively, is given of chute 12. It will be appreciated that chute 10 is substantially the same. Chains **18*a* and 18*b* are shown traveling through U-shaped tracks 86*a* and 86*b*. Mounted through opposing link joints of chains 18*a* and 18*b* are a plurality of parallel, spaced, pusher bars 88. Bars 88 have central spacer collars 90 to avoid backlash with the rounds of ammunition 52. Bars 88 have grooved ends 92 which engage rims 56 of ammunition 52 and prevent their axial movement. Also, a plurality of parallel, longitudinal, spaced ribs 94, 96 and 98 are illustrated engaging ammunition 52** at its rim and at various sections along its neck to transversely center it.

Referring to FIG. 8, a guide 100 is shown rotatably mounted both on chute 12 at joint 102 and on strut 104 at joint 106. Joint 102 has a common axle coaxially supporting guide 100 and sprocket pair 42. Guide 100 is mounted centrally within chute 12 while sprocket pair 42 are mounted on opposite sides within chute 12. Strut 104 is linked to loading assembly 30 by mechanical linkage (not shown) so that output edge 108 of guide 100 remains parallel to the input edge 110 of the guide 112 within loading assembly 30. Pusher bars 88 are shown herein traveling along interior path 114 and return path 116.

A telescoping dome 118 is shown overlaying the upper gap between chute 12 and loading assembly 30. Dome 118 includes parts 120 and 124 which are mounted on the chute 12 and loading assembly 30, respectively, to telescope around dome 118 as assembly 30 and chute 12 rotate with respect to each other. The ammunition 52 is shown entering assembly 30 along path 120 under the urging of hand-off wheel 122.

One of the pusher bars 88 is shown emerging onto return path 116 through return slot 124. This return slot 124 can be partially bridged by a finger means 126 shown herein as a reciprocating finger which is attached to guide 100 and is reciprocated by the action of a cam (not shown) attached to the aforesaid common axle. Finger 126 is timed to retract for an interval sufficient to allow pusher bars 88 to pass through return slot 124 and before re-extending. This allows the next round 52 to readily transfer from previously mentioned guide 100 to guide 112 without falling into return slot 124.

To facilitate an understanding of the principles associated with the foregoing apparatus, its operation will now be briefly described. It is assumed that magazine 20 has been filled with ammunition 52 so that each of the spaces between pusher bars 88 (FIG. 6) within magazine 20 contain a round 52 of ammunition. It is also assumed that the gun is moderately elevated so that the chutes 10 and 12 are in the positions illustrated in FIG. 3. Driving motor 74 ultimately drives sprocket **82*c* (FIG. 5) which drives sprocket 42 (FIG. 8). This causes chains 18 to move through chutes 10 and 12 and through magazine 20. Consequently, ammunition 52 is drawn from magazine 20, into chutes 10 and through chute 12. As ammunition 52 reaches guide 100 (FIG. 8) it is conveyed across the edge 108 of guide 100. The pusher bars 88 preceding each round of ammunition 52 then move toward return slot 124 as cam operated finger 126 is retracted. As pusher bars 88 pass through slot 124, finger 126 again extends to the position shown in FIG. 8. It will be observed therefore that the ammunition 52 has a bridge 126 crossing over slot 124**.

During such operation, the gun elevation may increase to its maximum shown in FIG. 2. It will be appreciated that the length of chain wrapped around sprocket **22*i* and 16 must necessarily decrease. Consequently, chains 18 would slacken were it not for the action of levers 24. As shown in FIG. 2, the unfolding of chutes 10 and 12 causes levers 24 to slide to the innermost position in slot 26. Consequently, sprockets 66 (FIG. 4) draw chains 18 inwardly to the maximum extent. This prevents slackening of the chain. It will be observed that levers 24, having a dog leg, do not interfere with arm 44**.

Next, the gun may rotate to the maximum depressed elevation shown in FIG. 1. It will be appreciated for the reverse of the reasons just given, chains 18 are wrapped to a greater length around sprockets 22*i* and 16. Consequently, chain 18 would be unduly stressed if it were not for the action of levers 24. As chutes 10 and 12 fold, levers 24 are driven to the outermost position in slot 26. Therefore, sprockets 66 (FIG. 4) move to an outermost position relieving chains 18 of any undue tension.

It is to be appreciated that various modifications may be implemented with respect to the above described preferred embodiment. For example, the length and direction of the chain path within the magazine can be altered depending upon magazine size and the number of rounds stored. In addition, while a lever sliding through a slot on a chute is illustrated, in other embodiments, the linkage may employ equipment geared to the joint between the chutes and use apparatus such as a rack and pinion to draw the chain inwardly. Also in some embodiments, certain idler sprockets may be eliminated depending upon the application. Also, while a fanned loading assembly is shown herein, in certain embodiments it may be eliminated. Furthermore, the apparatus driving the reciprocating finger may be derived from any part moving in synchronism with the chains. Moreover, the drive motor may be connected to alternate points in the drive train. It is also expected that the illustrated chutes may have different shapes and different guides depending upon the type of ammunition being handled. Additionally, the various dimensions and materials described herein may be altered depending upon the ammunition caliber, length, speed of operation, weight, space available, accuracy, etc.

Obviously, many modifications and variations of the present invention are possible in light of the above teachings. It is therefore to be understood that within the scope of the appended claims, the invention may be practiced otherwise than as specifically described.

I claim:

1. A feeder for transferring ammunition from a magazine to a loading assembly of an elevationally rotatable gun, comprising:

a first chute pivotally mounted about said magazine;

a second chute articulated between said first chute and said loading assembly, said chutes being sized to provide an internal passage for said ammunition;

endless transfer means for circulating along an interior path from said magazine through said chutes to drive said ammunition therethrough, said endless means returning from said interior path to said magazine along a return path; and linkage means coupled to said endless means along its return path for drawing it inwardly as said chutes unfold.

2. A feeder according to claim 1 wherein said linkage means is coupled between said chutes, said chutes folding upon said linkage means as the elevation of said gun changes in a given direction, said linkage means being operable to draw said endless means to an extent sufficient to eliminate slack.

3. A feeder according to claim 2 wherein said linkage means is pivotally mounted on one of said chutes and slidably mounted on the other.

4. A feeder according to claim 3 wherein said linkage means comprises:

a lever; and a wheel rotatably mounted about the swinging end of said lever, said endless means running over said wheel.

5. A feeder according to claim 4 wherein said wheel includes an axle, said second chute having a curved slot through which said axle slides.

6. A feeder according to claim 1 further comprising:

a pair of sprockets journaled to the end of said second chute adjacent said loading assembly, said endless means including a pair of spaced chains running alongside each other around different respective ones of said sprockets.

7. A feeder according to claim 6 further comprising:

a plurality of parallel spaced pusher bars connected between said chains;

a guide mounted coaxially with said sprockets on said second chute, said second chute being spaced at least partially from said loading assembly to form a return slot allowing said pusher bars to move out of said second chute and onto said return path; and finger means operable in synchronism with passing ones of said pusher bars to reciprocate from said guide over said return slot.

8. A feeder according to claim 7 wherein said guide and finger means are mechanically coupled to said loading assembly to rotate and maintain a predetermined alignment with said loading assembly.

9. A feeder according to claims 6, 7 or 8 wherein said linkage means is pivotally mounted on one of said chutes and slidably mounted on the other.

10. A feeder according to claim 8 wherein said linkage means comprises:

a lever pivotally mounted on one of said chutes and slidably mounted on the other;

a pair of wheels rotatably mounted about the swinging end of said lever, said pair of chains each running over a different corresponding one of said wheels.

11. A feeder according to claim 10 wherein said ammunition has a rim, each of said pusher bars having a grooved end sized to hold said rim.

12. A feeder according to claim 11 further comprising:

a plurality of spaced ribs mounted in parallel within said chutes and sized to guide said ammunition and limit its transverse motion.

13. A feeder according to claim 2 further comprising:

an arm mounted on and extending outwardly from said magazine toward said loading assembly;

at least one idler operable to guide said endless means and adjustable to set tension in said endless means.

14. A feeder according to claim 13 further including:

a track mounted within said chutes for guiding said endless means.

* * * * *